US006250343B1

(12) United States Patent
Chen

(10) Patent No.: US 6,250,343 B1
(45) Date of Patent: Jun. 26, 2001

(54) INFLATING CYLINDER WITH BOTH INFLATING AND AIR SUCKING EFFECTS

(76) Inventor: Chiang Pei Chen, 3F No. 80, Yi Ping Road, Tai Ping City, Taichung Hsien (TW)

( * ) Notice: Subject to any disclaimer, the term of this patent is extended or adjusted under 35 U.S.C. 154(b) by 0 days.

(21) Appl. No.: 09/534,359

(22) Filed: Mar. 24, 2000

(30) Foreign Application Priority Data

May 12, 1999 (TW) ..... 88207538

(51) Int. Cl.[7] ..... B65B 1/04
(52) U.S. Cl. ..... 141/65; 141/38
(58) Field of Search ..... 141/37, 38, 65, 141/66, 67; 222/251, 278, 282, 287, 288, 289; 417/493, 437

(56) References Cited

U.S. PATENT DOCUMENTS 4,287,819 * 9/1981 Emerit .

* cited by examiner

*Primary Examiner*—Steven O. Douglas
(74) *Attorney, Agent, or Firm*—Dougherty & Troxell

(57) ABSTRACT

Inflating cylinder with both inflating and air sucking effects, including: a cylinder body; a piston disposed in the cylinder body; a piston stem driven by a user's hand for driving the piston; a first one-way valve disposed at front end of the cylinder body, permitting the air to only flow from the interior of the cylinder body to outer side; a second one-way valve disposed at front end of the cylinder body, permitting the air to only flow from outer side into the cylinder body; and at least one air guiding member formed with an axial air way for air flow to flow therethrough. The air guiding member is detachably connected with the front end of the cylinder body and communicates with one of the one-way valves. When the air guiding member communicates with the first one-way valve, the inflating cylinder creates an inflating effect to inflate an article, while when the air guiding member communicates with the second one-way valve, the inflating cylinder creates an air sucking effect for sucking the air from the article.

6 Claims, 6 Drawing Sheets

INFLATING CYLINDER WITH BOTH INFLATING AND AIR SUCKING EFFECTS

BACKGROUND OF THE INVENTION

The present invention relates to an inflating device, and more particularly to an inflating cylinder having both inflating and air sucking effects.

A conventional inflating cylinder is used to inflate many articles such as a ball, a balloon, a swimming ring, etc. However, some of these articles, such as the swimming ring, must be deflated after used for easy storage. It is often experienced that it is difficult to totally extrude the air from the swimming ring simply by hands and a part of the air will remain in the swimming ring. The conventional inflating cylinder can only inflate the article, while failing to exhaust the air from the article.

Moreover, it is a simplest way to clean up waste articles such as garbage to place the articles in a plastic bag. However, the plastic bag containing the articles is generally expanded. After sealed, a great amount of air will occupy the interior of the plastic bag. Therefore, the plastic bag will have great volume and can be hardly carried and the garbage can will be quickly filled up by such plastic bag.

Similarly, many domestic articles such as comforter is enclosed in a plastic bag. Such plastic bag will have considerably large volume and can be hardly stored. In addition, many articles such as a camera or unsealed foods necessitate anti-humidity measure for storing the articles. Also, after drinking a beverage such as champagne or vintage the bottle of which is sealed by a cock, it is difficult to re-cock the bottle for reserving the beverage.

SUMMARY OF THE INVENTION

It is therefore a primary object of the present invention to provide an inflating cylinder having both inflating and deflating effects. The inflating cylinder is able to exhaust the air from an inflated article.

It is a further object of the present invention to provide the above inflating cylinder having both inflating and deflating effects. The inflating cylinder enables an article to be stored by less volume.

It is still a further object of the present invention to provide the above inflating cylinder having both inflating and deflating effects. The inflating cylinder enables an article to be stored under anti-humidity protection.

It is still a further object of the present invention to provide the above inflating cylinder having both inflating and deflating effects. The inflating cylinder enables a bottle to be re-cocked after unsealed.

The present invention can be best understood through the following description and accompanying drawings wherein:

DETAILED DESCRIPTION OF THE PREFERRED EMBODIMENTS

Figure 1:
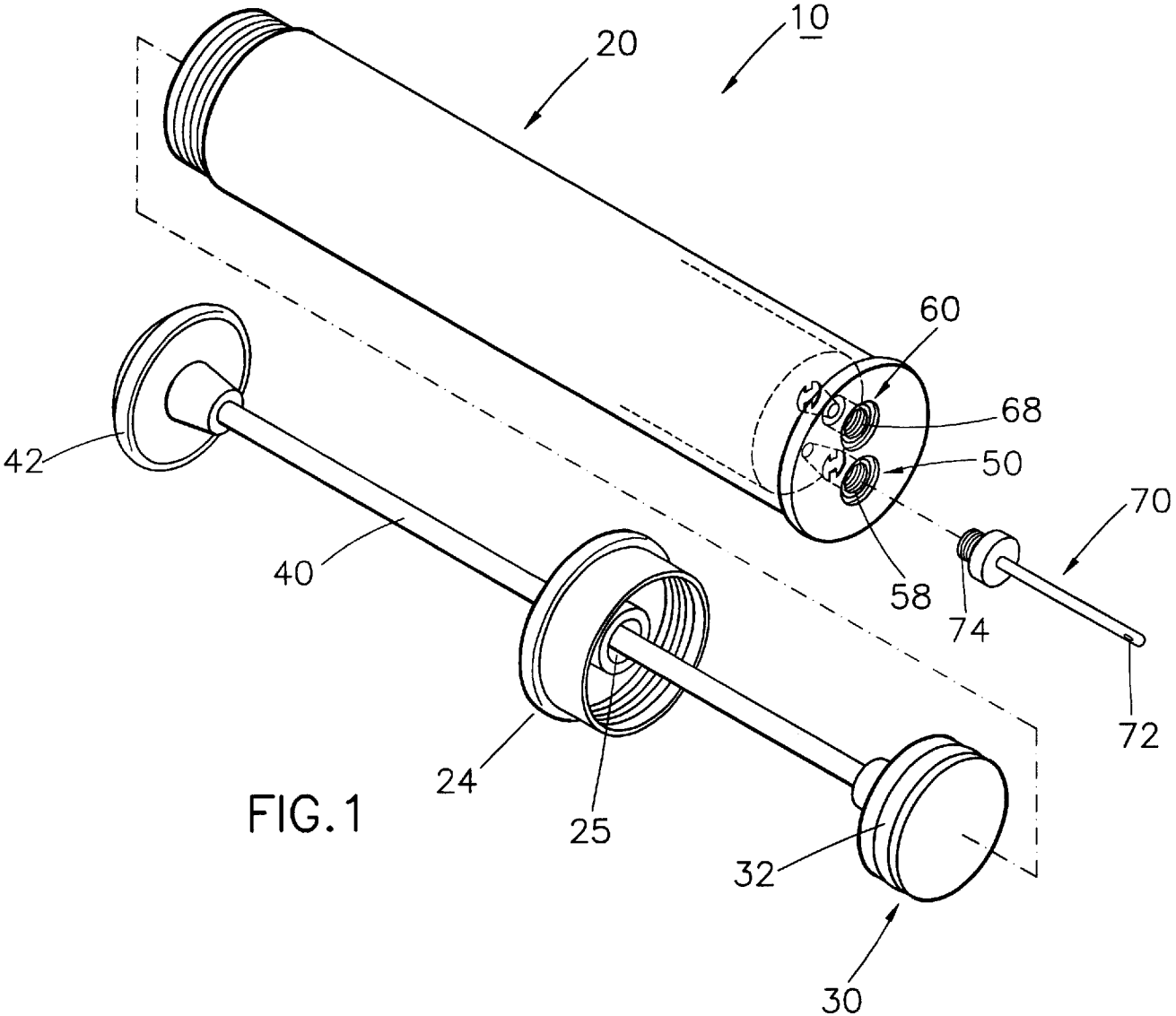
FIG. 1 is a perspective exploded view of an embodiment of the present invention.
Figure 2:
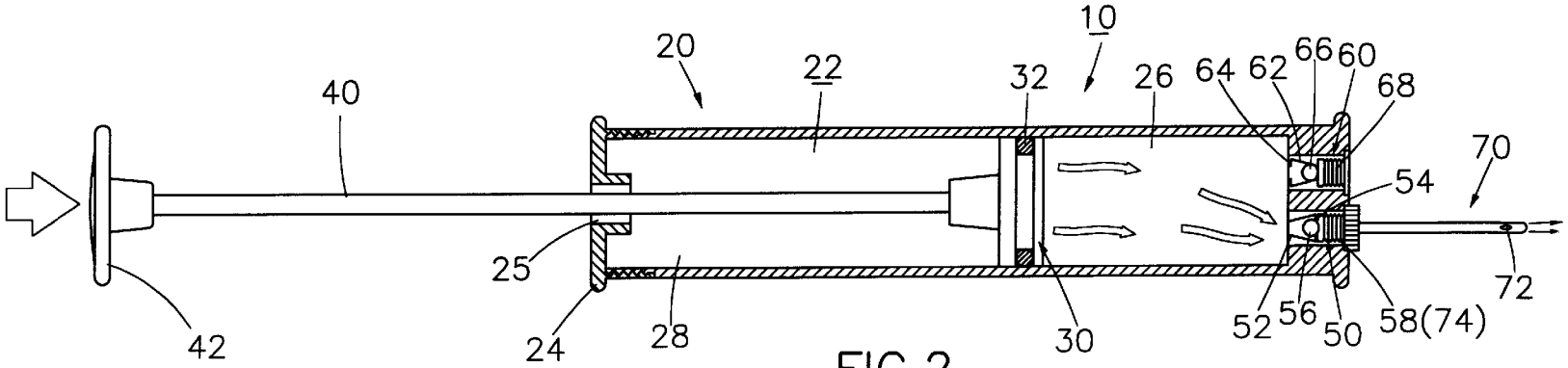
FIG. 2 is a longitudinal sectional assembled view according to FIG. 1, showing the inflation operation in one state.

Please refer to FIGS. 1 and 2. According to a first embodiment, the inflating cylinder 10 of the present invention includes:

- a hollow cylinder body 20 defining an air chamber 22, a rear end of the cylinder body 20 being sealed by a rear cap 24;
- a piston 30, a leakproof member being fitted around the circumference of the piston 30, the leakproof member being an O-ring 32, the piston 30 being disposed in the air chamber 22 of the cylinder body 20 with the O-ring 32 airtight engaged with the inner wall of the air chamber 22, the piston 30 dividing the air chamber into two spaces, one space between the front end of the cylinder body and the piston forming a compression room 26, the circumferential face of the piston being totally airtight engaged with the inner wall of the cylinder body so that the air in the two spaces divided by the piston cannot communicate with each other;
- a piston stem 40 one end of which extends from a through hole 25 of the rear cap 24 into the cylinder body to connect with the piston 30 for slidably driving the piston, the other end of the piston stem 40 being positioned outside the cylinder body and disposed with a grip 42 for a user to grip with a hand;
- a first one-way valve 50, in this embodiment, the one-way valve being a copper-made product embedded in the front end of the cylinder body 20, the first one-way valve allowing air to flow from the interior of the cylinder body to outer side, while preventing the air from flowing from outer side into the cylinder body, in order to achieve this effect, the one-way valve 50 having a conic flow passage 52 with large front end and small rear end, the front end of the flow passage 52 being disposed with two inward projecting engaging sections 54, an airtight member which is a ball body 56 being rollably disposed in the flow passage 52, when the ball body 56 is stopped at the rear end of the flow passage, an airtight state being formed, the rear end of the flow passage 52 communicating with the compression room 26, a pivot section 58 which is a thread hole being disposed at the front end of the one-way valve 50 to communicate with the front end of the flow passage 52 for air flow to flow therethrough;
- a second one-way valve 60, in this embodiment, the one-way valve being a copper-made product embedded in the front end of the cylinder body 20, the second one-way valve 60 and the first one-way valve 50 being arranged side by side, allowing air to flow from the outer side into the cylinder body, while preventing the air from flowing from the interior of the cylinder body to outer side, similarly, the one-way valve 60 having a conic flow passage 62 with small front end and large rear end, the rear end of the flow passage 62 being disposed with two inward projecting engaging sections 64, an airtight member which is a ball body 66 being rollably disposed in the flow passage 62, the ball body 66 being stopped by the engaging sections 64 from detaching out, when the ball body 66 is stopped at the front end of the flow passage, an airtight state being formed, the rear end of the flow passage 62 communicating with the compression room 26, a pivot section 68 which is a thread hole being disposed on the one-way valve 60 at the front end of the flow passage 62 to communicate with the flow passage; and at least one air guiding member 70 which is a member able to conduct air flow, in this embodiment, the air guiding member 70 being a so-called ball pin having an axial air way ( not shown ), the air way having at least one vent 72 at front end of the air guiding member 70, the rear end of the air guiding member 70 having a threaded connecting section 74, the connecting section 74 being connected with one of the pivot sections 58, 68 of the one-way valves 50, 60.

When inflating, the air guiding member 70 is connected to the first one-way valve 50 as shown in FIG. 2 and extended into an article to be inflated. The piston 30 is pressed toward the compression room 26. The compressed high pressure air will act onto the two one-way valves 50, 60. When the second one-way valve 60 suffers the action of the high pressure air, the ball body 66 is moved forward to seal the flow passage 62 into an airtight state, whereby the air cannot escape from the second one-way valve 60. When the first one-way valve 50 suffers the action of the high pressure air, the ball body 56 is moved forward and stopped by the two engaging sections 54. At this time, the air can still flow through the gap between the ball body 56 and the flow passage 52. Therefore, the compressed air in the compression room will totally escape from the first one-way valve 50 to flow through the vent 72 of the air guiding member 70 and fill into the article to be inflated.

Figure 3:
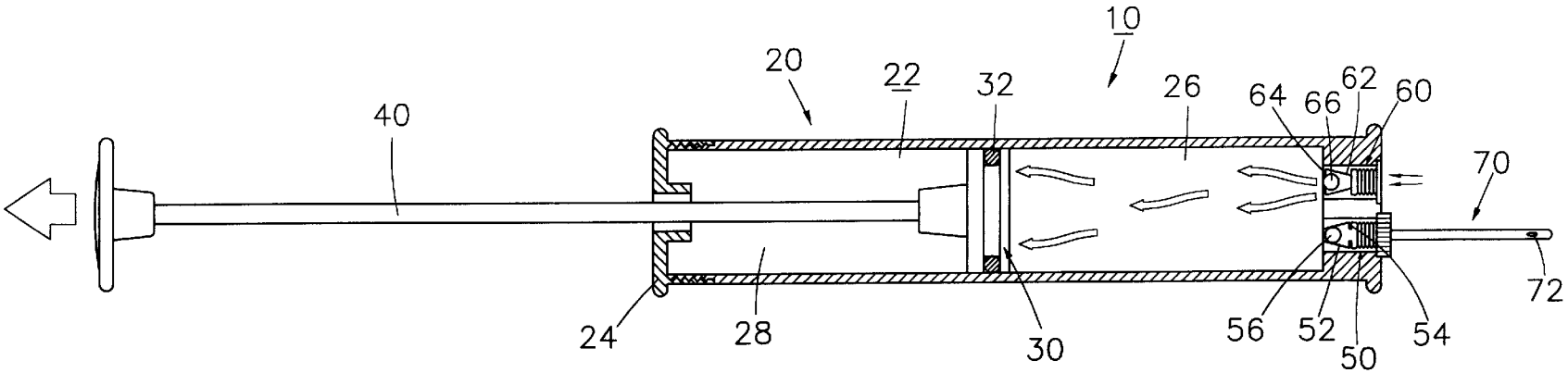
FIG. 3 is a view according to FIG. 2, showing the inflation operation in another state.

After the forward travel of the piston 30 in FIG. 2 ends, the piston is then slided backward to the rear end of the cylinder body as shown in FIG. 3 to start the backward travel. At this time, the space of the compression room 26 is enlarged and the air pressure is reduced into a value less than one atmosphere of the ambient environment. When the second one-way valve 60 is operated by the atmosphere, the ball body 66 is moved backward and stopped by the engaging sections 64. At this time, a gap exists between the ball body 66 and the flow passage 62 for the air to flow therethrough. Therefore, the atmosphere can totally go through the second one-way valve 60 to supplement the compression room and restore the same into one atmosphere for the piston to again compress.

When the air in the inflated article flows back into the cylinder body 20, the ball body 56 of the first one-way valve 50 will be moved backward to seal the rear end of the flow passage 52 into an airtight state. Therefore, the air in the inflated article is one-way airtight sealed and cannot flow through the one-way valve 50 into the cylinder body.

When the piston further compresses the compression room, the air in the compression room will further fill into the inflated article. The operation of FIGS. 2 and 3 is repeated to inflate the article into a certain air pressure.

The air chamber 28 behind the piston 30 via the through hole 25 of the rear cap 24 communicates with ambience and always keeps under one atmosphere. Therefore, the air will not be supplemented into this space to form high pressure air.

Figure 4:
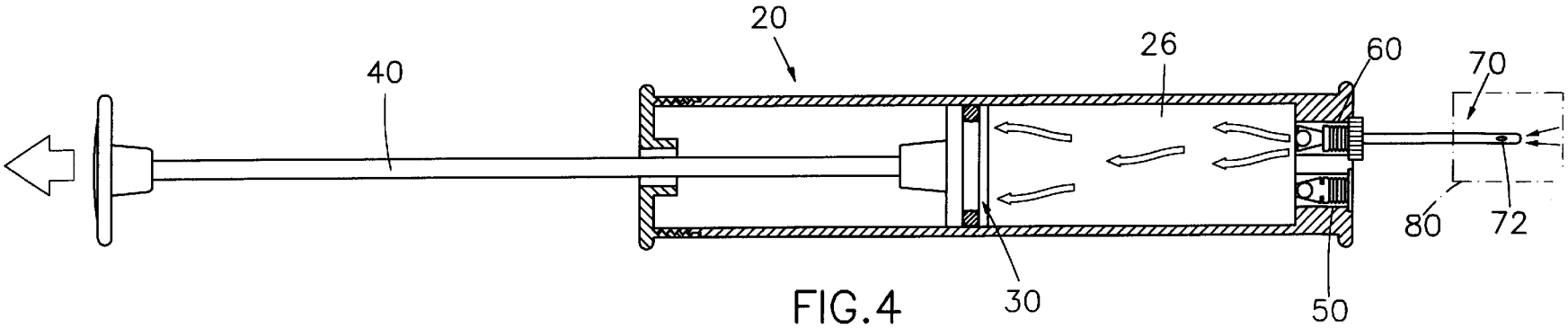
FIG. 4 shows the deflation operation of the embodiment of the present invention in one state.

When deflating the article, the air guiding member 70 is connected to the second one-way valve 60 as shown in FIG. 4 and extended into the article 80. The piston 30 is slided backward. At this time, the air pressure in the compression room 26 is reduced and the air in the article 80 will flow from the air guiding member 70 and the one-way valve 60 into the compression room to keep the air pressure balanced. In the state of FIG. 4, the second one-way valve 60 will not form the airtight state and the air in the article is permitted to be supplemented into the compression room. While the first one-way valve 50 forms one-way airtight state so that the ambient atmosphere cannot flow through the first one-way valve into the cylinder body. Therefore, the air filling into the compression room totally comes from the article 80.

After the travel of FIG. 4 ends, the piston 30 is then slided to the compression room 26 to compress the air therein. In this state, the second one-way valve 60 is one-way airtight, while the first one-way valve 50 permits the air to flow therethrough. Therefore, the air compressed in the compression room can totally escape from the first one-way valve into the ambient atmosphere.

Figure 5:
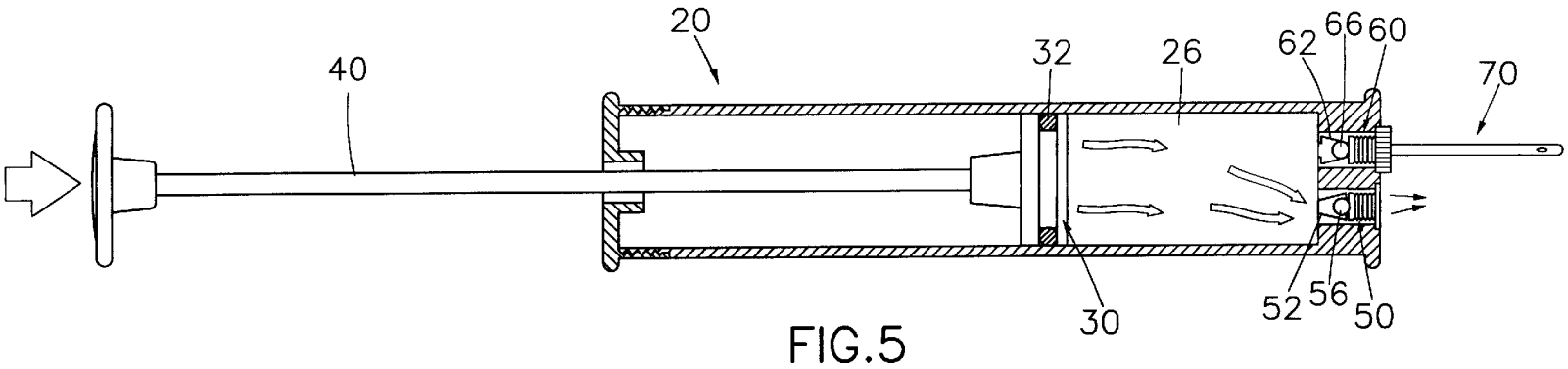
FIG. 5 is a view according to FIG. 4, showing the deflation operation in another state.

The operation of FIGS. 4 and 5 can be repeated to entirely exhausted the air from the article 80 into the atmosphere.

Figure 6:
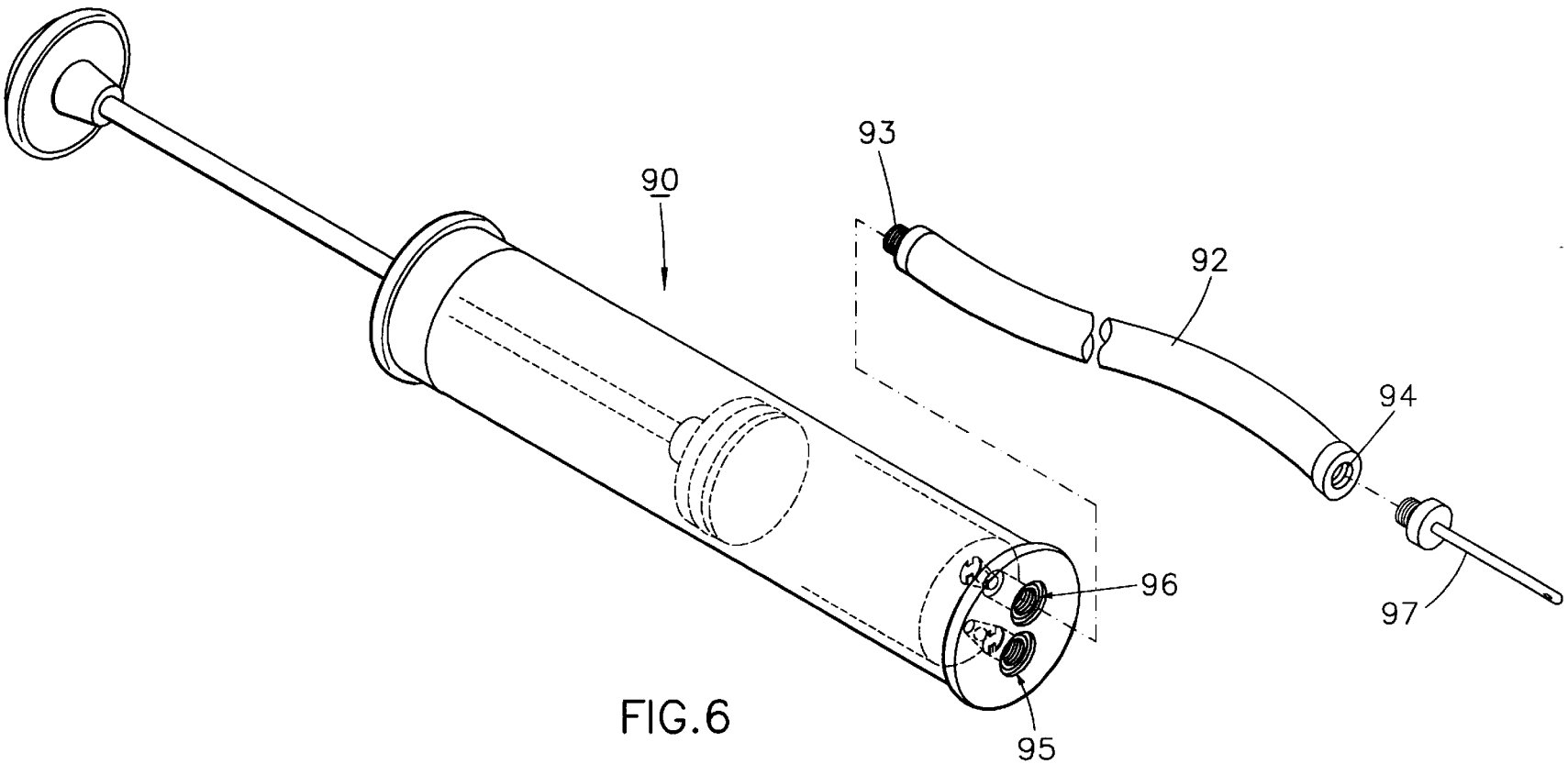
FIG. 6 is a perspective exploded view of another embodiment of the present invention.

FIG. 6 shows another embodiment of the present invention, in which the inflating cylinder 90 is co-used with a hose 92. A connecting section 93 of rear end of the hose is connected with any of the one-way valves 95, 96. The pivot section 94 at front end of the hose is connected with the air guiding member 97.

Figure 7:
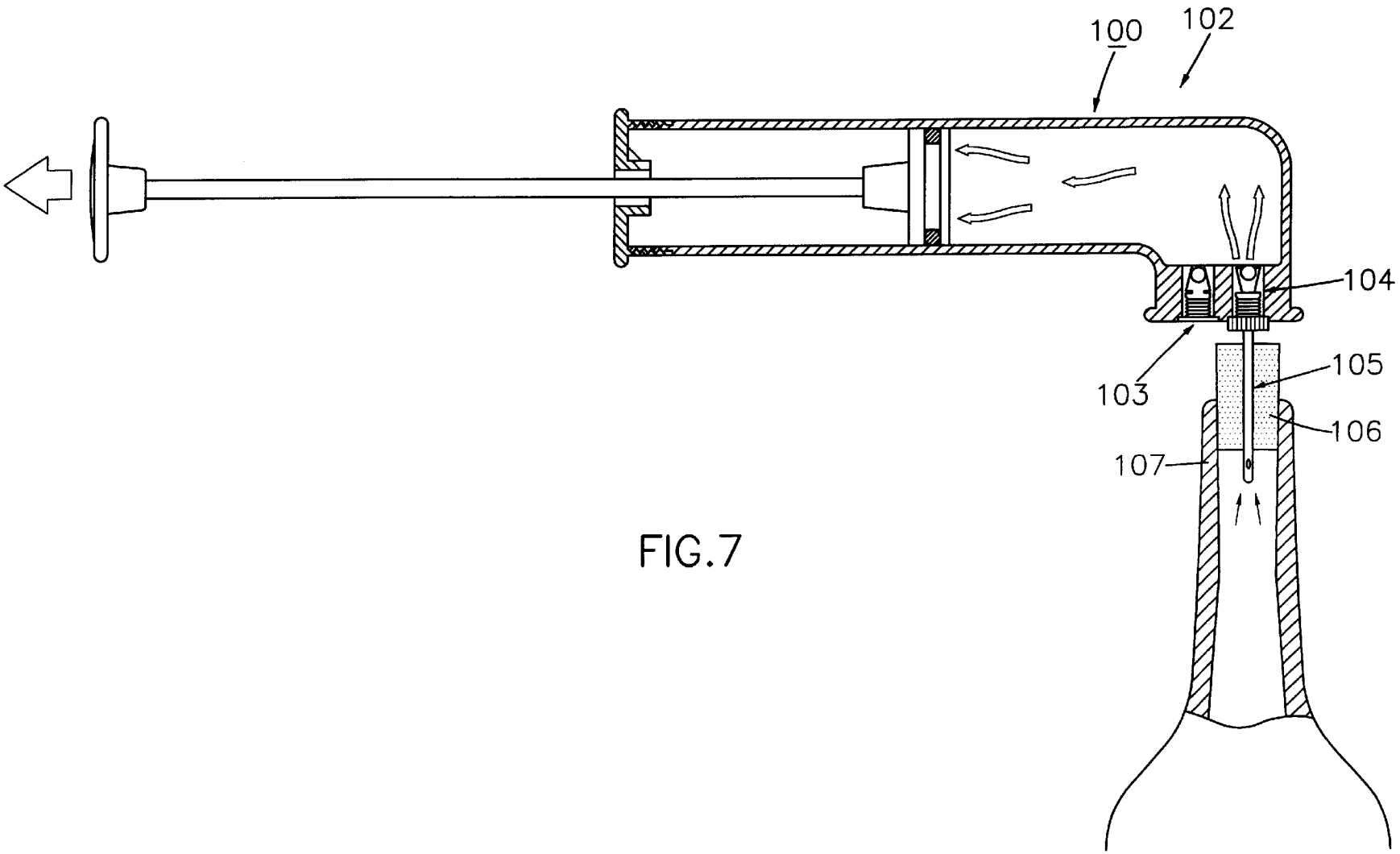
FIG. 7 is a sectional view of still another embodiment of the present invention, showing the operation thereof in one state.

FIG. 7 shows still another embodiment of the present invention, which is different from the above two embodiments in that the cylinder body 102 of the inflating cylinder 100 is L-shaped, whereby the front end of the cylinder body 102 and the body thereof contain an angle.

The present invention has the following functions:

1a. The inflating cylinder of the present invention has both inflating and deflating effects. After inflated, in the case that it is necessary to deflate the article, the air in the article can be totally sucked out by the inflating cylinder and the user need not laboriously squeeze the article. The air sucking effect is much better than the squeezing effect of a user.

2a. In the case that articles are placed into a plastic bag for cleaning, a user can hold the opening of the plastic bag and extend the air guiding member into the plastic bag from the sealed opening so as to suck out the air in the plastic bag. Accordingly, the amount of the air in the plastic bag can be reduced and the volume of the plastic bag can be reduced for easy carriage and reduce the stacking volume. Similarly, in the case that a comforter is contained in a plastic bag for storage, the air can be sucked out from the plastic bag so as to compact the plastic bag and the comforter and reduce the volume thereof for easy storage.

3a. The air in a bag body can be sucked out to form a vacuumized state. This provides an anti-humidity effect for the stored article.

Figure 8:
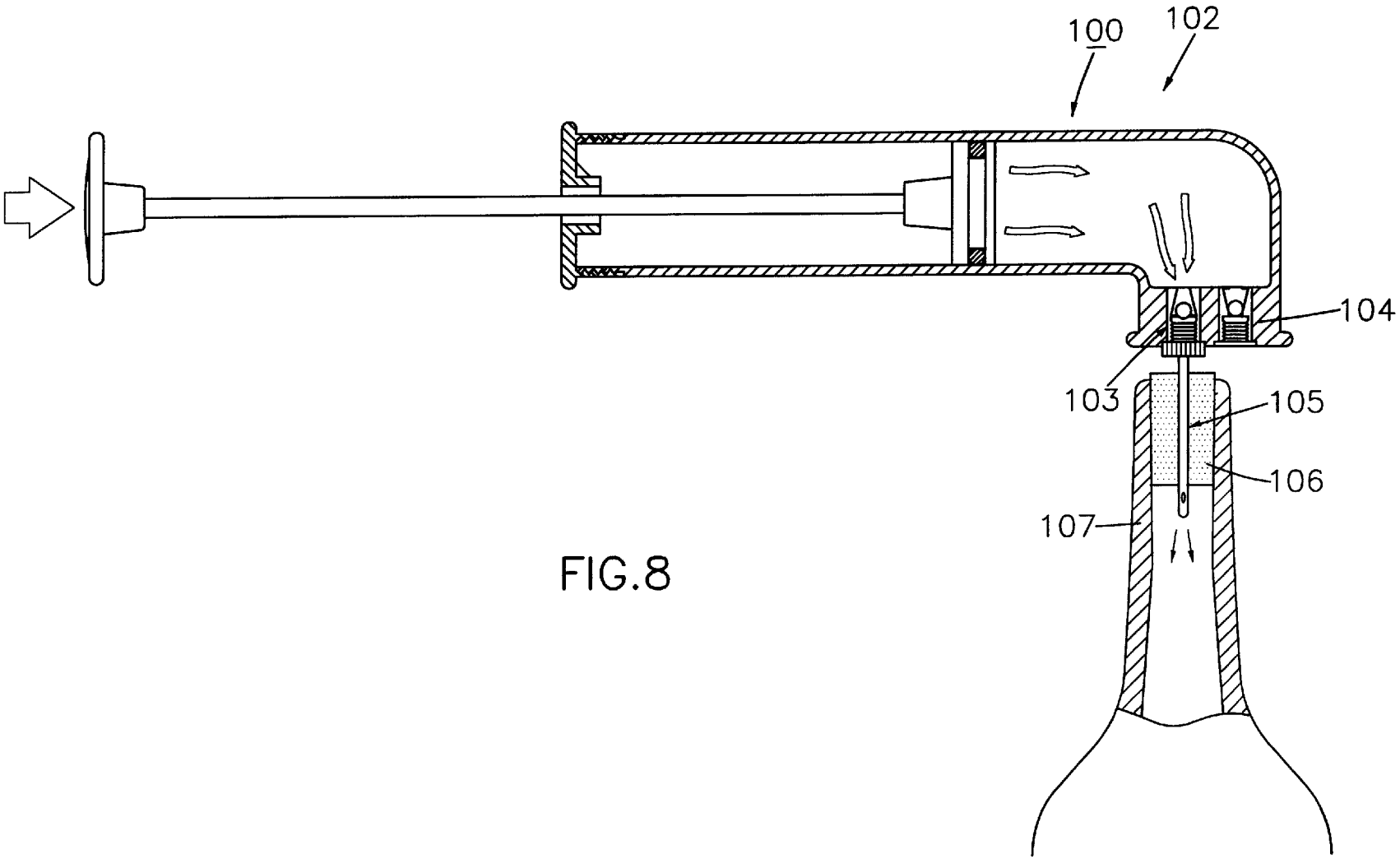
FIG. 8 is a view according to FIG. 7, showing the operation in another state.

4a. In the application of the embodiment of FIG. 7, the air guiding member 105 is connected to the second one-way valve 104 and passed through the cock 106 so as to suck out the air from the bottle 107 and make the air pressure therein less than one atmosphere. Therefore, a sucking force is provided to easily re-cock the bottle with the cock 106. When it is desired to extract the cock, the air guiding member 105 is connected to the first one-way valve 103 and passed through the cock 106 as shown in FIG. 8 so as to fill air into the bottle and make the air pressure therein greater than the atmosphere. Under such circumstance, the cock is outward pushed by the air pressure to facilitate extraction of the cock.

The above embodiments are only used to illustrate the present invention, not intended to limit the scope thereof. Many modifications of the above embodiments can be made without departing from the spirit of the present invention.

What is claimed is:

1. An inflating cylinder with both inflating and air suction effects, comprising:

a cylinder body defining therein an air chamber;

a piston disposed in the air chamber of the cylinder body and airtightly engaged with an inner wall of the air chamber, a compression room being defined between the piston and a first end of the cylinder body;

a piston stem extended through a second end of the cylinder body and a first end of the piston stem connected with the piston for driving the piston to slide, a second end of the piston stem being positioned outside the cylinder body to be gripped by a user;

a first one-way valve disposed at the first end of the cylinder body and communicating with the compression room, whereby the air can only flow from the interior of the cylinder body to outside the cylinder body;

a second one-way valve disposed at the first end of the cylinder body and communicating with the compression room, whereby the air can only flow from outside the cylinder body into the cylinder body; and at least one air guiding member formed with an axial air way for air to flow therethrough, the air guiding member being detachably connected with the first end of the cylinder body and communicating with one of the first and second one-way valves, whereby when the air guiding member communicates with the first one-way valve, the inflating cylinder creates an inflating effect and when the air guiding member communicates with the second one-way valve, the inflating cylinder creates an air suction effect.

2. The inflating cylinder as claimed in claim 1, wherein the first one-way valve includes: a flow passage with a large front end and a smaller rear end; an airtight member movably disposed in the flow passage, such that when the airtight member is stopped at the rear end of the flow passage, an airtight state is formed; and a pivot section disposed at and communicating with the front end of the flow passage, the air guiding member having a connecting section connected with the pivot section.

3. The inflating cylinder as claimed in claim 2, wherein the one-way valve has a predetermined number of engaging sections between the front end of the flow passage and the pivot section.

4. The inflating cylinder as claimed in claim 1, wherein the second one-way valve includes: a flow passage with a small front end and a larger rear end; an airtight member movably disposed in the flow passage, such that when the airtight member is stopped at the front end of the flow passage, an airtight state is formed; and a pivot section disposed at and communicating with the front end of the flow passage, the air guiding member having a connecting section connected with the pivot section.

5. The inflating cylinder as claimed in claim 4, wherein the one-way valve has a predetermined number of engaging sections at the rear end of the flow passage.

6. The inflating cylinder as claimed in claim 1, wherein first end of the cylinder body is oriented at a predetermined angle with respect to the cylinder body.

* * * * *